US006419513B1

(12) United States Patent
Choy

(10) Patent No.: US 6,419,513 B1
(45) Date of Patent: Jul. 16, 2002

(54) CARD EDGE CONNECTOR

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/849,040

(22) Filed: May 3, 2001

(51) Int. Cl.[7] ..... H01R 13/62
(52) U.S. Cl. ..... 439/326; 439/92
(58) Field of Search ..... 439/325–329, 439/92, 108, 64, 630

(56) References Cited

U.S. PATENT DOCUMENTS 5,997,332 A * 12/1999 Choy ..... 439/328
6,162,069 A * 12/2000 Choy ..... 439/92
6,164,998 A * 12/2000 Poi et al. ..... 439/326
6,234,821 B1 * 5/2001 Tan ..... 439/328

* cited by examiner

*Primary Examiner*—Hien Vu
(74) *Attorney, Agent, or Firm*—Wei Te Chung

(57) ABSTRACT

A card edge connector comprises an insulative housing defining a central slot with a plurality of contacts by two sides. A pair of latches are positioned at two opposite ends of the housing. Each latch includes a plastic portion and a metal portion. The plastic portion includes a locking lug. The metal portion is retained to the housing with a guidance/protection stud generally in alignment with the corresponding locking lug in a vertical direction so that the locking lug will not be damaged during downward rotational installation of the card module into the housing.

8 Claims, 7 Drawing Sheets

CARD EDGE CONNECTOR

BACKGROUND OF THE INVENTION

1. Field of the Invention

The invention relates to electrical connectors, and particularly to the card edge connector with the plastic/metal hybrid type latches thereof for retaining a card module therein.

2. The Related Art

U.S. Pat. No. 6,162,069 having the same applicant and the same assignee with the invention, discloses the card edge connector with the plastic/metal hybrid type latches thereof for retaining a card module in the connector. In such a design, the hybrid type latch includes a plastic portion integrally formed with the housing with a locking lug thereon, and a metal portion positioned beside the plastic portion with the soldering portion for mounting to a printed circuit board, the grounding portions for electrical engagement with the grounding pads on the inserted card module, and restraint means for supportably restricting lateral movement of the plastic portion.

It is experienced that the locking lug of the plastic portion tends to be damaged by the side edge section of the inserted card module during downwardly rotational installation of the card module because the substrate of the card module is so rigid while the tiny locking lug is not relatively strong enough to endure/resist the scrapping effect during the downward movement of the card module and the associated outward movement of the plastic portion). Thus, it is desired to find the solution for preventing this shortcoming.

Therefore, an object of the invention is to provide means for protecting the locking lug of the plastic portion from being damaged during downwardly rotational installation of the card module with regard to the connector.

SUMMARY OF THE INVENTION

According to an aspect of the invention, a card edge connector comprises an insulative housing defining a central slot therein for receiving a card module therein. A plurality of contacts are disposed by two sides of the central slot for electrical engagement with inserted card module. A pair of hybrid latches are positioned at two opposite ends of the housing. Each latch includes a plastic portion and a metal portion aside. The plastic portion integrally extends from the housing with a locking lug thereof. The metal portion includes a main body with retention means secured to the housing. The metal portion further includes a guidance/protection stud compliantly covering the locking lug so that when the card module is downwardly rotated from a slanted initial insertion position to a horizontal final reception position, the locking lug of the plastic portion does not directly confront the side edge section of the inserted card module and thus does not endure the significant downward force exerted by the downward moving card module. Instead, such force is imposed upon the guidance/protection stud of the metal portion. Accordingly, the locking lug of the plastic portion may only actively/strongly abut against the card module after the card module has passed and been located in its final horizontal reception position, while being insignificantly/smoothly outwardly deflected during rotational installation of the card module with regard to the connector because of existence of the guidance/protection stud.

DETAILED DESCRIPTION OF THE PREFERRED EMBODIMENTS

Figure 1:
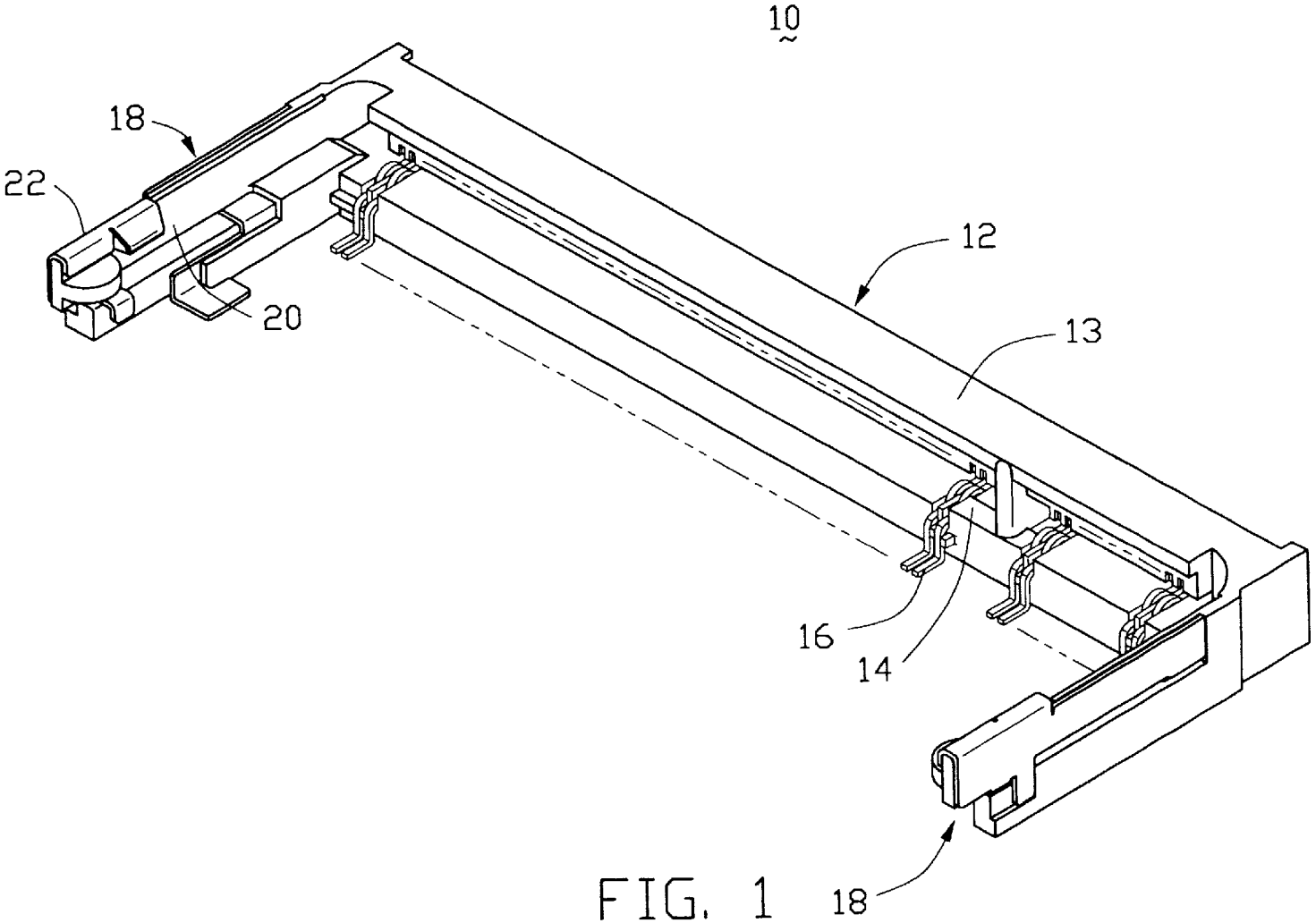
FIG. 1 is a perspective view of an embodiment of the card edge connector, according to the invention.
Figure 2:
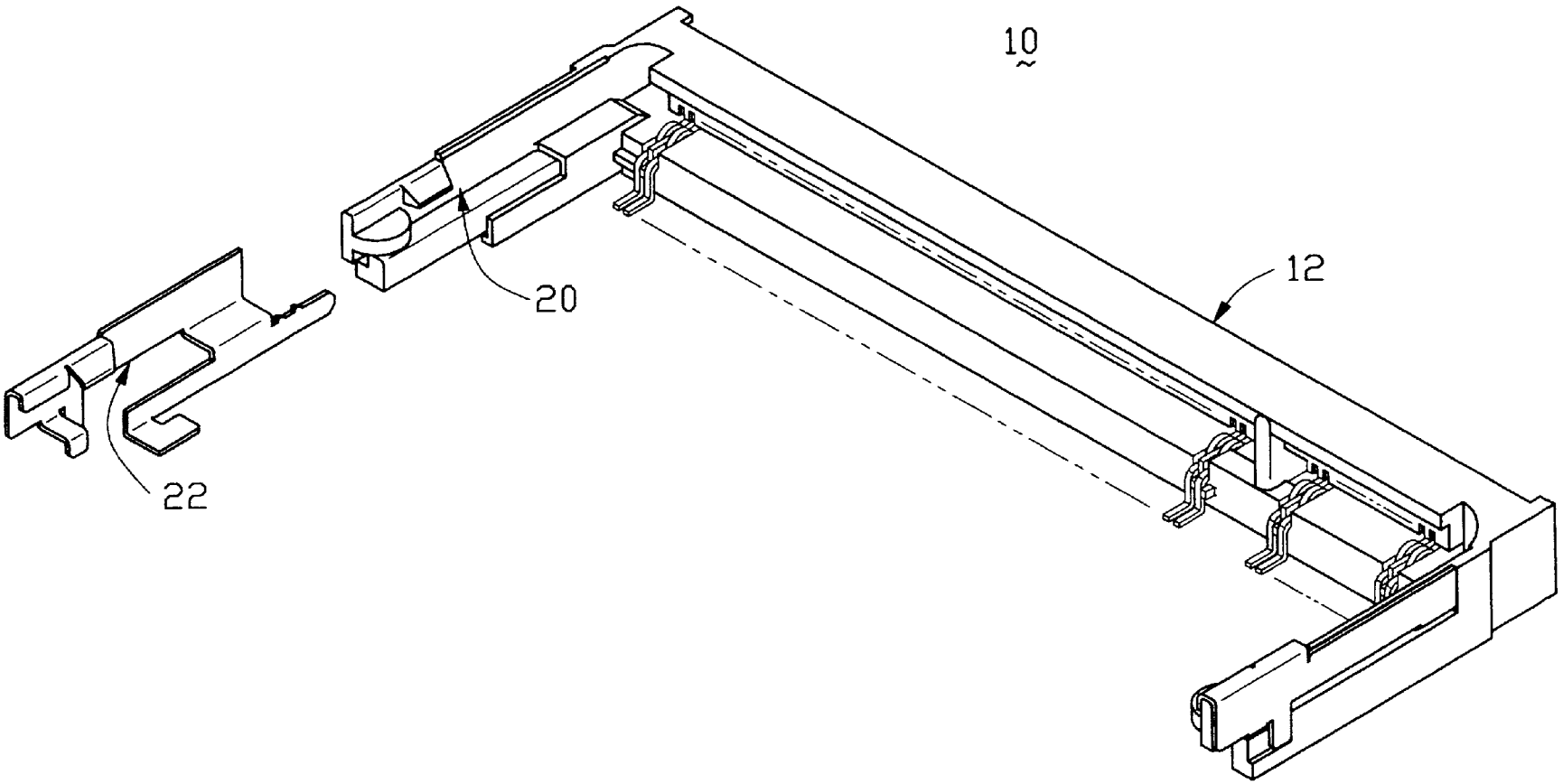
FIG. 2 is an exploded perspective view of the connector of FIG. 1 with the metal portion of a hybrid type latch is disassembled from the housing.
Figure 3:
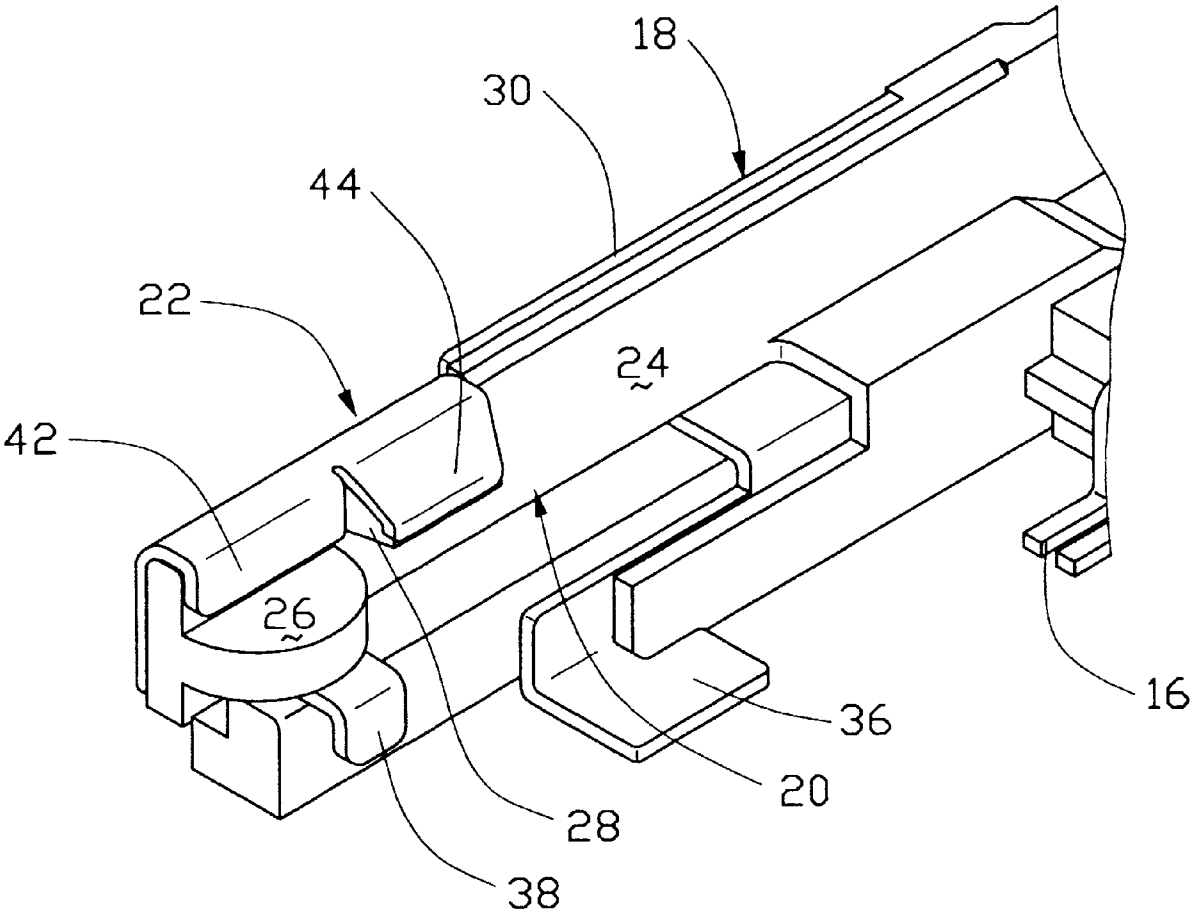
FIG. 3 is an enlarged partial perspective view of the connector of FIG. 1 to show the hybrid type latch thereof.
Figure 4:
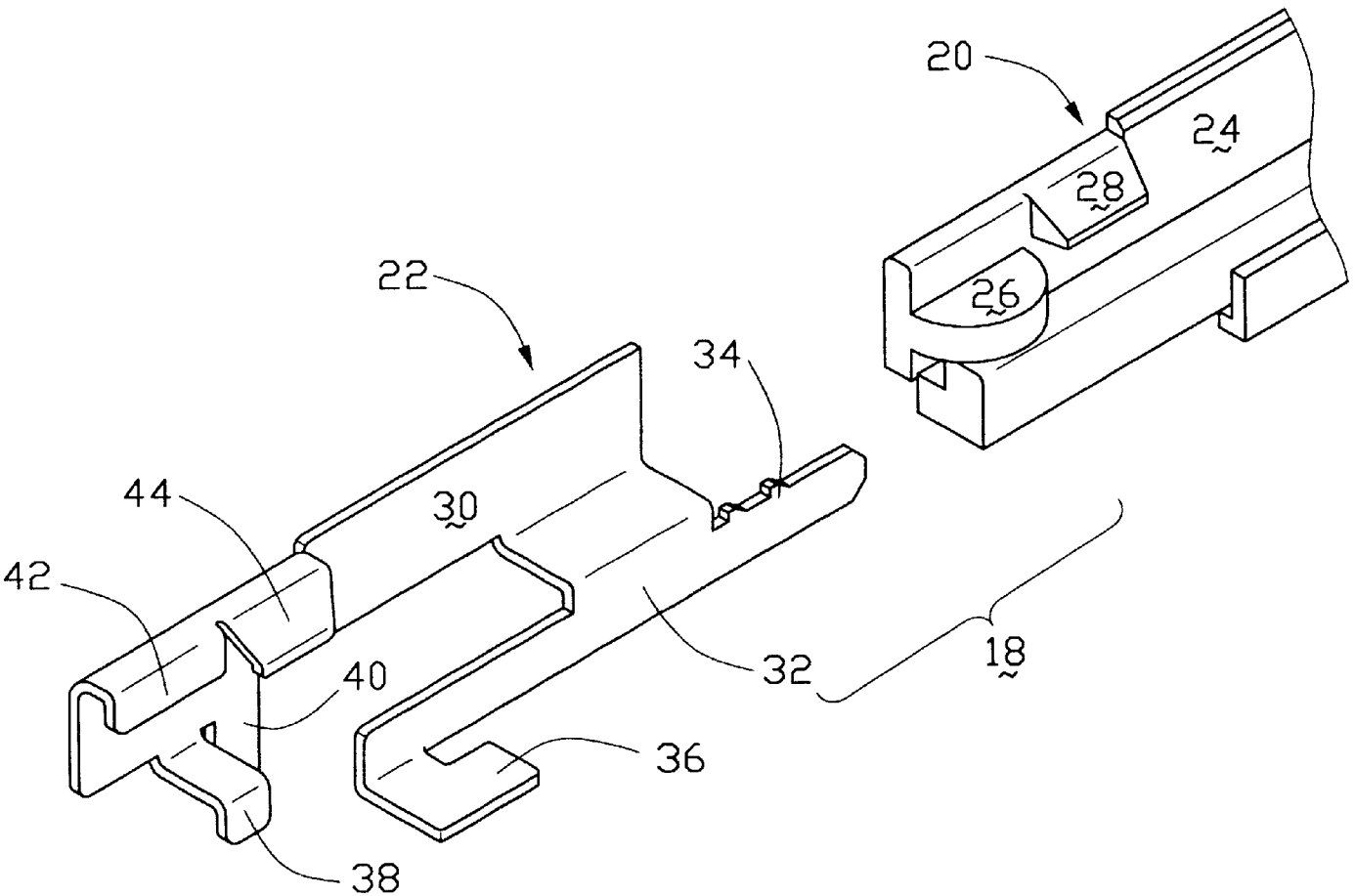
FIG. 4 is an exploded enlarged partial perspective view of the connector of FIG. 3 to show the separate metal portion of the hybrid type latch.
Figure 5:
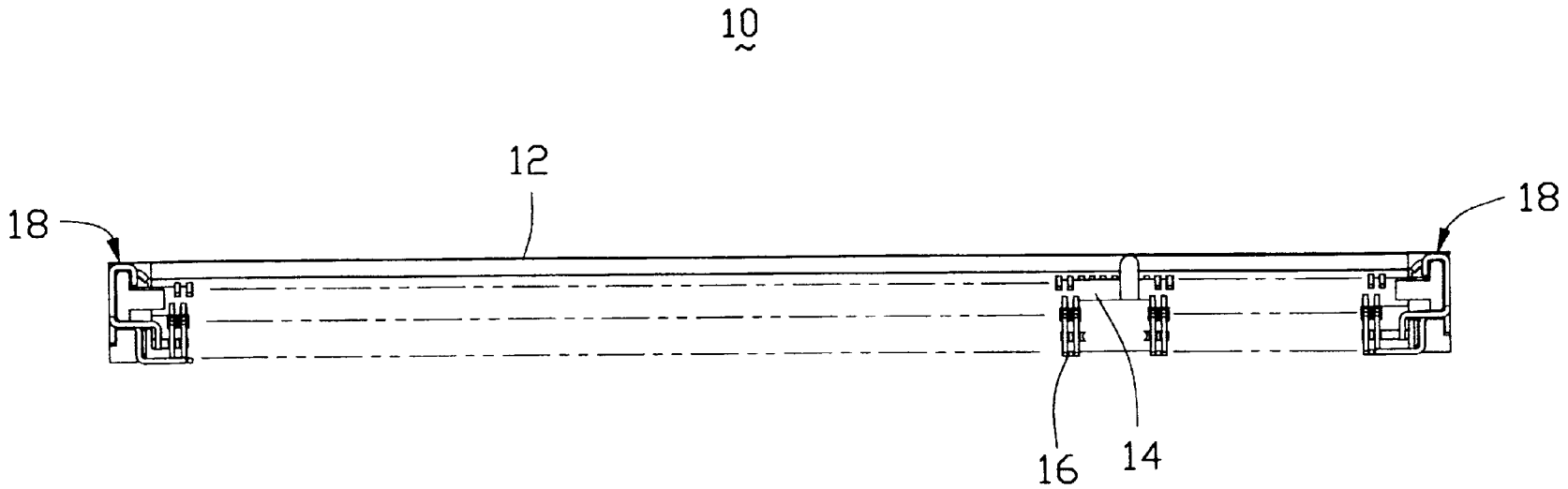
FIG. 5 is an elevational view of the connector of FIG. 1.
Figure 6:
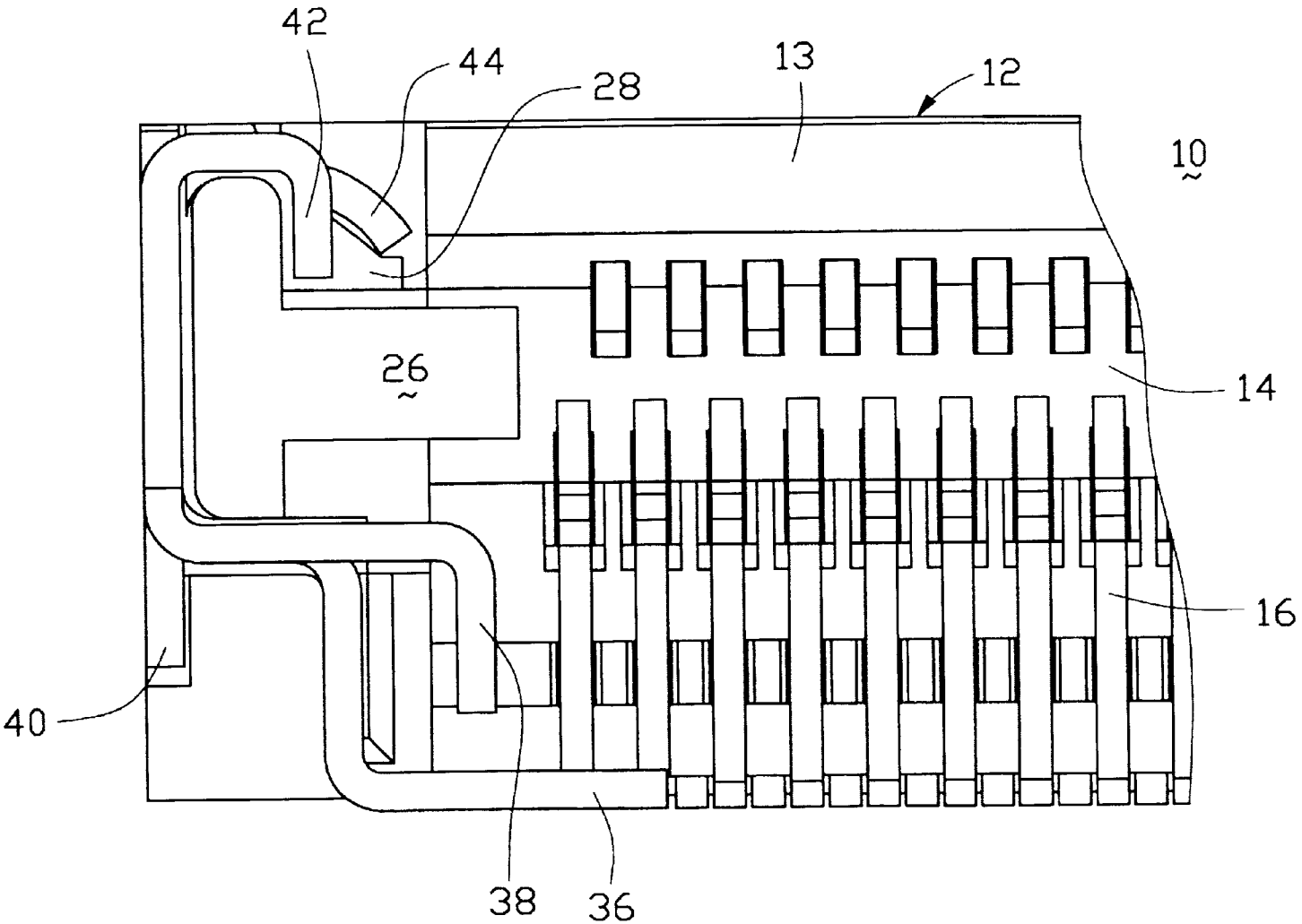
FIG. 6 is an enlarged partial elevational view of the connector of FIG. 5.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–6 wherein a card edge connector 10 includes an insulative housing 12. The housing 12 includes a base 13 defining a central slot 14 therein with a plurality of contacts 16 by two sides of the central slot 14. A pair of hybrid type latches 18 are positioned at two opposite ends of the housing 12.

Each hybrid type latch 18 includes a plastic portion 20 integrally formed with the base 13 and a metal portion 22. The plastic portion 20 includes an arm 24 with a restraint head 26 at the distal free end and a locking lug 28 adjacent to the restraint head 26. The metal portion 22 includes a main body 30, a retention section 32 extending from the main body 30 with barbs 34 thereon for interferential engaged with the base 13. A solder pad 36 is formed on the other end of the retention section 32. Two restriction tags 38, 40 extend downwardly from the main body 30 for restraining the left-to-right deflection of the plastic portion 20. An abutment tag 42 extends from the other side of the main body 30 opposite to the restriction tags 30, 40 for cooperating with the main body 30 to co-move with the plastic portion 20. A guidance/protection stud 44 extends from an upper edge of the main body with a configuration in compliance with the locking lug 28 and covers, in a vertical direction thereof, the locking lug 28 from the top.

Figure 7:
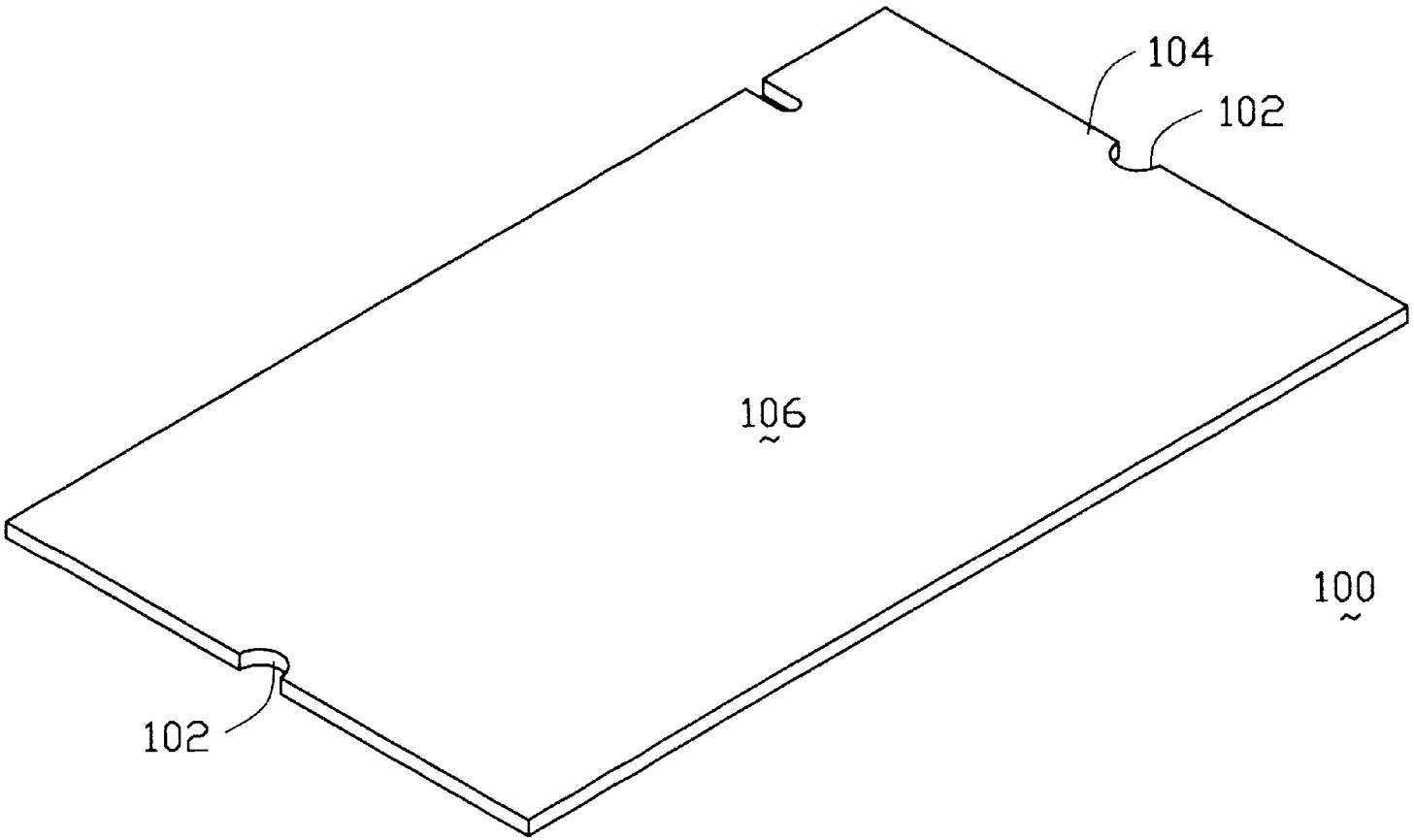
FIG. 7 is a perspective view of the card module used within the connector of FIG. 1.

FIG. 7 shows the card module 100 used with the connector 10, having a pair of notches 102 at two opposite side edge sections 104.

During installation of the card module 100 into the connector 10, the card module 100 is first inserted, at an initial slanted position, into the central slot 14 with its bottom edge. Afterwards, the card module 100 is downwardly rotated to have the two opposite side edge sections 104 outwardly push away the corresponding latches 18 and to reach its final horizontal position. During this downward rotational movement of the card module 100, the side edge sections 104 of the card module 100 directly engage and impose the forces upon the guidance/protection stud 44 of the metal portion 22 of the latches 18 while without direct/significant improper scrapping/deflecting force imposed upon the locking lug 28. When the card module 100 is moved to its final horizontal position, the restraint head 26 is received within the notch 102 of the card module 100 for restraining movement of the card module 100 relative to the connector 10 along the front-to-back direction thereof, and the locking lug 28 abuts against the top surface 106 around two side edge sections 104 for preventing inverse rotation derived from the spring forces of the contacts 16. Understandably, similar to the traditional way, the card module 100 can be released from the connector 10 by outwardly deflecting the latches 18 to have the locking lugs 28 disengaged from the two side edge sections 104 of the card module 100.

Under this configuration, the locking lug 28 may still actively function as the locking means to efficiently retain the card module 100 in position in the connector 10 for resisting the inverse rotation due to the spring forces of the contact 16, while will no longer endure the direct/significant forces from the card module during the downward rotational installation period. Rather, the guidance/protection stud 44 absorbs the imposed forces and transmitted to the metal portion 22 instead. Thus, the locking lug 28 and the corresponding plastic portion 20 can smoothly outwardly deflected without damages thereof to allow passage of the downward movement of the card module 100.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, the guidance/protection stud may not need to be exactly compliantly same as the locking lug. The key point to configure the guidance/protection stud in proper shape and dimension so as to have the card module optimally first contact and successively substantially outwardly push the guidance/protection stud instead of the locking lug during rotational installation of the card module.

Therefore, person of ordinary skill in this field are to understand that all such equivalent structures are to be included in the scope of the following claims.

I claim:

1. A card edge connector for use with a card module, comprising:

an insulative housing having a base defining an elongated central slot therein;

a plurality of contacts positioned beside said central slot;

a pair of hybrid type latches disposed at two opposite ends of the base;

each of said latches including a plastic portion and a metal portion beside said plastic portion, said plastic portion integrally formed on the housing with a restraint head around the distal end and a locking lug beside said restraint head;

said metal portion including a main body with retention means for retaining the metal portion to the housing, said metal portion being arranged to co-move with the plastic portion; wherein said metal portion includes a guidance/protection stud generally in alignment with the locking lug in a vertical direction thereof, said guidance/protection stud covering said locking lug in said vertical direction for preventing the locking lug from being damaged during downwardly rotational installation of the card module into the connector; wherein said guidance/protection stud is configured in compliance with the locking lug; wherein said metal portion further includes an abutment tab positioned above the restraint head.

2. The connector as described in claim 1, wherein said retention means of the metal portion further includes a solder pad for mounting to a printed circuit board on which the connector is seated.

3. A card edge connector for use with a card module, comprising:

an insulative housing having a base defining an elongated central slot therein;

a plurality of contacts positioned beside said central slot;

a pair of hybrid type latches disposed at two opposite ends of the base, each of said latches including a plastic portion and a metal portion beside said plastic portion, said plastic portion integrally formed on the housing with a locking lug around the distal end portion;

said metal portion including a main body directly secured to the housing, said metal portion being arranged to co-move with the plastic portion; wherein said metal portion includes a guidance/protection stud which is dimensioned and configured relative to the locking lug in a way so that the guidance/protection stud directly confronts and engages two side sections of the card module and substantially endure forces exerted by said card module in place of the locking lug for preventing the locking lug from being damaged during downwardly rotational installation of the card module into the connector, wherein said guidance/protection stud is generally aligned with the locking lug in a vertical direction, wherein said plastic portion further includes a restraint head on an outer side relative to said locking lug.

4. The connector as described in claim 3, wherein said guidance/protection stud is configured to conform to the locking stud.

5. The connector as described in claim 3, wherein said locking lug is configured not to directly engage the card module during downwardly rotational installation of the card module into the connector.

6. A connector assembly comprising;

a card edge connector and a card module therein, said connector comprising:

an insulative housing having a base defining an elongated central slot therein;

a plurality of contacts positioned beside said central slot;

a pair of hybrid type latches disposed at two opposite ends of the base;

each of said latches including a plastic portion and a metal portion beside said plastic portion, said plastic portion integrally formed on the housing with a locking lug around the distal end portion;

said metal portion including a main body positioned beside the plastic portion, said metal portion being arranged to co-move with the plastic portion; wherein said metal portion includes a guidance/protection stud which is dimensioned and configured relative to the locking lug in a way that the guidance/protection stud directly confronts and engages two side sections of the card module and substantially endure forces exerted by said card module in place of the locking lug for preventing the locking lug from being damaged during downwardly rotational installation of the card module into the connector, wherein said guidance/protection stud is generally aligned with the locking lug in a vertical direction, wherein said plastic portion further includes a restraint head on an outer side of said locking lug to be received within a corresponding notch formed in a side edge section of the card module.

7. The connector as described in claim 6, wherein said guidance/protection stud is configured to conform with the locking stud.

8. The connector as described in claim 6, wherein said locking lug is configured not to directly engage the card module during downwardly rotational installation of the card module into the connector.

* * * * *